US008241070B2

(12) United States Patent
Matsuzawa

(10) Patent No.: US 8,241,070 B2
(45) Date of Patent: Aug. 14, 2012

(54) ELECTRICAL CONNECTOR

(75) Inventor: Atsushi Matsuzawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 70 days.

(21) Appl. No.: 12/883,409

(22) Filed: Sep. 16, 2010

(65) Prior Publication Data

US 2011/0076892 A1 Mar. 31, 2011

(30) Foreign Application Priority Data

Sep. 30, 2009 (JP) ..... 2009-225990

(51) Int. Cl.
*H01R 13/502* (2006.01)

(52) U.S. Cl. ..... 439/701

(58) Field of Classification Search ..... 439/701
See application file for complete search history.

(56) References Cited

U.S. PATENT DOCUMENTS 5,535,513 A 7/1996 Frantz
6,089,925 A * 7/2000 Maltais et al. ..... 439/701
6,394,822 B1 * 5/2002 McNamara ..... 439/108
6,752,156 B2 * 6/2004 Wagoner ..... 131/305
6,764,349 B2 * 7/2004 Provencher et al. ..... 439/701

FOREIGN PATENT DOCUMENTS

JP 2000-506664 A 5/2000
JP 2002-100443 A 4/2002
JP 2002-530839 9/2002
JP 2005-510850 A 4/2005
WO 03/047049 A1 6/2003

OTHER PUBLICATIONS

Office Action for Japanese Patent Application 2009-225990, Japan Patent Office, Aug. 9, 2011.

* cited by examiner

*Primary Examiner* — Truc Nguyen
(74) *Attorney, Agent, or Firm* — Kubotera & Associates, LLC

(57) ABSTRACT

An electrical connector includes a signal blade including a first base member formed of an insulation material and a signal circuit portion formed on the first base member; a power source blade including a second base member formed of an insulation material and a power source circuit portion formed on the second base member, said power source blade further including an engaging protrusion; and a holding member formed of an insulation material and including a blade holding hole so that the engaging protrusion engages an inner surface when the power source blade is inserted into the blade holding hole.

5 Claims, 9 Drawing Sheets

ELECTRICAL CONNECTOR

BACKGROUND TECHNOLOGY AND RELATED TECHNOLOGY

The present invention relates to an electrical connector having a connecting portion at each of end portions thereof, so that the connecting portion is electrically connected to a corresponding portion of a circuit board or a mating connector.

In a conventional electrical connector, tow circuit boards are positioned with a relatively large distance therebetween, and circuit portions of the circuit boards are connected. In this case, a connecting member such as the conventional electrical connector is attached to the circuit portions of the circuit boards. Accordingly, the circuit portions are connected with a specific distance therebetween corresponding to a height of the conventional electrical connector.

Patent Reference has disclosed such a conventional electrical connector. The conventional electrical connector is formed as a connector assembly of two connectors disposed on each of the circuit boards.

Patent Reference: Japanese Patent Publication No. 2002-530839

In the conventional electrical connector described above, each of the connectors has an insulation case for accommodating a plurality of modules arranged in parallel to each other. When the connectors are assembled, terminals disposed on the modules are electrically connected, thereby forming the connector assembly.

In the conventional electrical connector, each of the modules has a plurality of terminals (circuit portions) on one surface of an insulation supporting member formed in a plate shape, and a shield member formed of a metal plate on the other surface. Each of the modules further has one end portion as a part of the insulation supporting member on each of both edges in a direction that the terminals are arranged on the insulation supporting member. When the modules are inserted into the insulation case, the insulation case supports the one end portion of the module.

As described above, in the conventional electrical connector, each of the modules has the one end portion as the part of the insulation supporting member, and the insulation case supports the one end portion of the module. Accordingly, when it is necessary to secure sufficient strength, it is necessary to increase a size of the one end portion. As a result, a size of the modules increases, thereby increasing a size of the conventional electrical connector holding the modules. On the other hand, when the size of the one end portion decreases, the strength of the one end portion decreases.

Further, in the conventional electrical connector described above, the shield member formed of a metal plate is separately attached to the module for a signal terminal after the insulation supporting member is formed. The shield member is simply attached to the insulation supporting member through a mechanical way. Accordingly, the shield member is not attached to the insulation supporting member with sufficient strength, so that it is difficult to sufficiently support the modules with the insulation case through the shield member.

Further, in the conventional electrical connector described above, the shield member is not attached to the module for power source (refer to as a blade). Accordingly, it is necessary to support the module for power source with the insulation case through a part of the insulation supporting member. As a result, it is difficult to increase the strength of the conventional electrical connector, and to decrease the size thereof.

In view of the problems described above, an object of the invention is to provide an electrical connector capable of solving the problems of the conventional electrical connector. In the electrical connector of the present invention, it is possible to securely support a power source blade without increasing a size of the electrical connector.

Further objects and advantages of the invention will be apparent from the following description of the invention.

SUMMARY OF THE INVENTION

In order to attain the objects described above, according to a first aspect of the present invention, an electrical connector has a signal blade. In the signal blade, a plurality of signal circuit portions is disposed in parallel on a base member formed of an insulation material in a plate shape, so that the signal circuit portions connect connecting portions disposed on both end portions of the base member.

According to the first aspect of the present invention, the electrical connector further has a power source blade. In the power source blade, a power source circuit portion formed of a metal plate is integrally disposed on a base member formed of an insulation material in a plate shape, so that the power source circuit portion connects connecting portions disposed on both end portions of the base member.

According to the first aspect of the present invention, the electrical connector further has a holding portion formed of an insulation material. In the holding portion, a blade holding hole is formed therethrough in a slit shape.

According to the first aspect of the present invention, in the electrical connector, the signal blade and the power source blade are guided at guided side edges formed on the base members thereof, and are inserted in the blade holding hole to a specific position. Accordingly, the signal blade and the power source blade are arranged on planes in parallel to plate surfaces of the base members, and the connecting portions of the signal blade and the power source blade are situated at an opening side of the blade holding hole.

According to the first aspect of the present invention, in the electrical connector, the power source blade has an engaging protrusion on a side edge of the power source circuit portion and protruding sideways beyond the guided side edge of the power source blade. When the power source blade is inserted into the blade holding hole, the engaging protrusion engages a corresponding surface of the blade holding hole.

In the first aspect of the present invention, the power source circuit portion formed of the metal plate is integrally held with the base member formed of the insulation material. Accordingly, it is possible to strongly hold the power source circuit portion with the base member. Further, the power source blade has the engaging protrusion on the side edge of the power source circuit portion and protruding sideways beyond the guided side edge of the power source blade. The engaging protrusion is formed as a part of the power source circuit portion formed of the metal plate. Accordingly, even if the engaging protrusion does not protrude to a large extent, the engaging protrusion inherently has large strength.

Further, the engaging protrusion protrudes in a thickness direction by a length within a thickness of the metal plate. Accordingly, it is possible to confine the length of the protrusion within a thickness of the base member, thereby making it possible to prevent a size of the power source blade from increasing. As a result, it is possible to make the power source blade in a compact size. Further, the engaging protrusion engages the corresponding surface of the blade holding hole. Accordingly, it is possible to strongly hold the power source blade with the holding portion.

According to a second aspect of the present invention, in the electrical connector, the base member of the power source blade has a regulated portion, and the holding portion has a regulating portion on the inner surface of the blade holding hole. Accordingly, when the power source blade is inserted into the blade holding hole to a specific position, the power source blade abuts against the holding portion to set a position of the power source blade. When the regulating portion of the holding portion abuts against the regulated portion of the power source blade, the holing portion holds the power source blade at a specific position in an insertion direction of the power source blade.

According to a third aspect of the present invention, in the electrical connector, when both end portions of the power source blade are not apart by a large distance, the holding portion may be formed of one single member. In this case, the power source blade is inserted into the blade holding hole of the holding portion in one direction. The engaging protrusion is disposed at rear end portion of the power source blade in the insertion direction.

According to a fourth aspect of the present invention, in the electrical connector, when the both end portions of the power source blade are apart by a large distance, the holding portion may be formed of divided holding portions situated at the both end portions of the power source blade. In this case, the power source blade is inserted into the corresponding divided holding portion from an end portion of the base member. Further, the power source blade includes the engaging protrusion corresponding to each of the divided holding portions.

In the fourth aspect of the present invention, when a spacer member is disposed between the divided holding portions at the both end portions of the power source blade, it is possible to securely maintain positions of the divided holding portions. With the divided holding portions, it is possible to easily deal with a change in a height of the power source blade. When the spacer member is disposed, it is possible to easily deal with a change in the height of the power source blade simply through replacing the spacer member.

According to a fifth aspect of the present invention, in the electrical connector, the power source blade includes a band groove portion in a plate surface of the base member of the power source blade extending in the insertion direction to the holding portion. The holding portion includes a band protrusion portion on the inner surface of the blade holding hole for guiding the band groove portion.

According to the fifth aspect of the present invention, it is preferred that the band groove portion and the band protruding portion have tightly holding portions held tightly with each other when the power source blade is inserted into the blade holding hole of the holding portion to a specific position. Accordingly, with the band protruding portion and the band groove portion, it is possible to securely hold the power source blade in a width direction, in addition to the insertion direction of the power source blade. As a result, it is possible to securely position the power source blade.

According to a sixth aspect of the present invention, in the electrical connector, it is preferred that the power source blade include a rib on the plate surface of the base member of the power source blade for pressing a corresponding inner surface of the blade holding hole of the holding portion. When the rib presses the corresponding inner surface of the blade holding hole, it is possible to securely hold the power source blade in the width direction, in addition to the insertion direction of the power source blade. As a result, it is possible to securely position the power source blade. In particular, it is possible to prevent the power source blade from wobbling in the blade holding hole in the thickness direction.

As described above, in the present invention, in the power source blade, the power source circuit portion formed of the metal plate is integrally disposed and held on the base member formed of the insulation material. Further, the power source blade has the engaging protrusion protruding sideways beyond the guided side edge of the power source blade. When the power source blade is inserted into the blade holding hole, the engaging protrusion engages the corresponding surface of the blade holding hole, thereby strongly holding the power source blade. Accordingly, it is possible to form the engaging protrusion protruding by a small length, thereby preventing a size of the power source blade from increasing to a large extent. Further, it is possible to securely hold the power source blade.

BRIEF DESCRIPTION OF THE DRAWINGS

FIGS. 2(A) and 2(B) are perspective views showing a power source blade of the electrical connector according to the first embodiment of the present invention, wherein FIG. 2(A) is a perspective view showing an inner surface side of the power source blade of the electrical connector, and FIG. 2(B) is a perspective view showing an outer surface side of the power source blade of the electrical connector;

FIGS. 3(A) and 3(B) are perspective views showing a signal blade of the electrical connector according to the first embodiment of the present invention, wherein FIG. 3(A) is a perspective view showing an inner surface side of the signal blade of the electrical connector, and FIG. 3(B) is a perspective view showing an outer surface side of the signal blade of the electrical connector;

FIGS. 4(A) to 4(C) are sectional views showing the electrical connector according to the first embodiment of the present invention, wherein FIG. 4(A) is a sectional view showing the electrical connector taken along a line 4(A)-4(A) in FIG. 4(C), FIG. 4(B) is a sectional view showing the electrical connector taken along a line 4(B)-4(B) in FIG. 4(C), and FIG. 4(C) is a sectional view showing the electrical connector taken along a line 4(C)-4(C) in FIG. 4(B);

FIGS. 6(A) and 6(B) are perspective views showing a power source blade of the electrical connector according to the second embodiment of the present invention, wherein FIG. 6(A) is a perspective view showing an inner surface side of the power source blade of the electrical connector, and FIG. 6(B) is a perspective view showing an outer surface side of the power source blade of the electrical connector;

FIGS. 7(A) and 7(B) are perspective views showing a signal blade of the electrical connector according to the second embodiment of the present invention, wherein FIG. 7(A) is a perspective view showing an inner surface side of the signal blade of the electrical connector, and FIG. 7(B) is a perspective view showing an outer surface side of the signal blade of the electrical connector;

FIGS. 8(A) and 8(B) are sectional views showing the electrical connector according to the second embodiment of the present invention, wherein FIG. 8(A) is a sectional view showing the electrical connector corresponding to FIG. 4(A), and FIG. 8(B) is a sectional view showing the electrical connector corresponding to FIG. 4(B); and FIGS. 9(A) and 9(B) are perspective views showing a power source blade and a signal blade of an electrical connector according to a third embodiment of the present invention, wherein FIG. 9(A) is a perspective view showing the power source blade and the signal blade of the electrical connector in a state that the electrical connector is set in a jig, and FIG. 9(B) is a perspective view showing the jig.

DETAILED DESCRIPTION OF THE PREFERRED EMBODIMENTS

Hereunder, embodiments of the invention will be described with reference to the accompanying drawings.

First Embodiment

Figure 1:
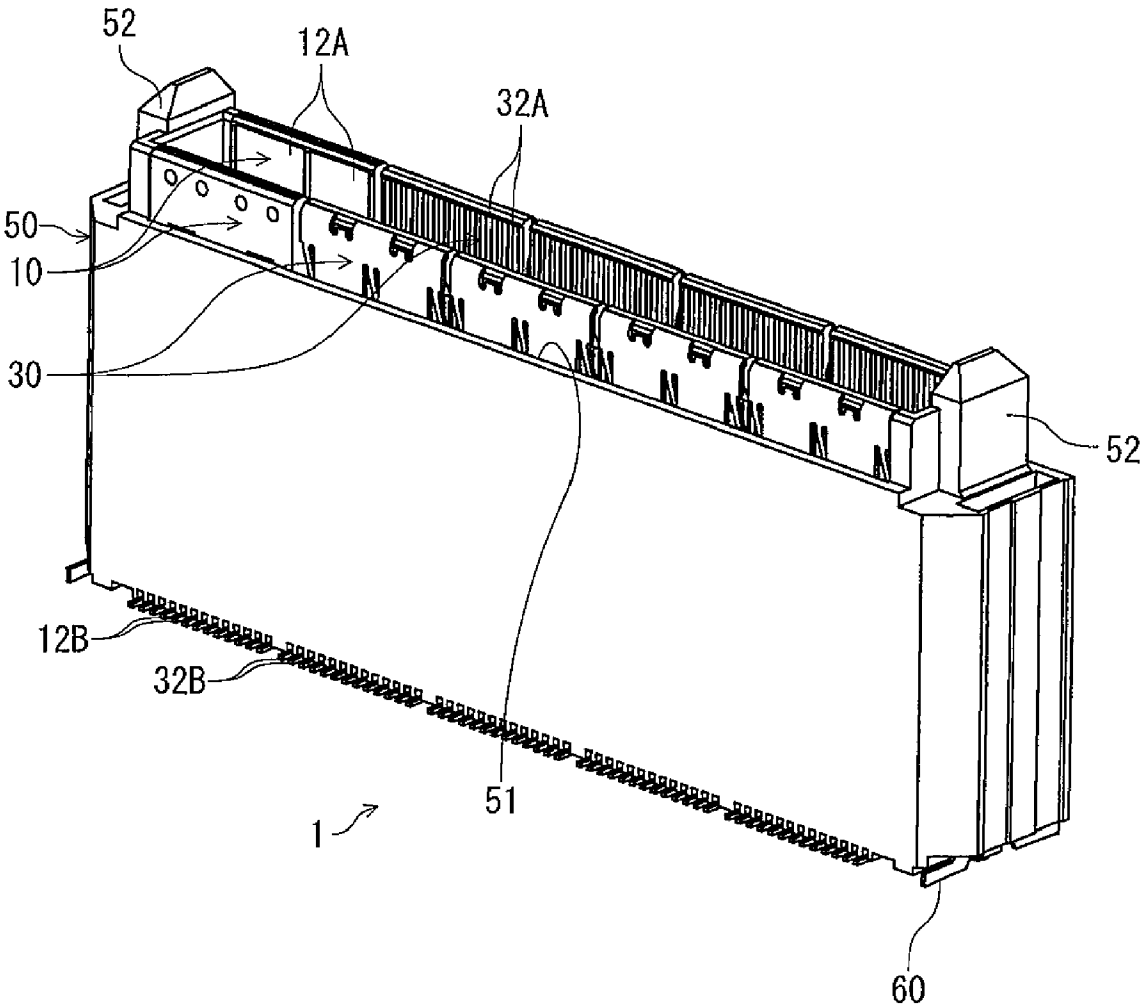
FIG. 1 is a perspective view showing an electrical connector according to a first embodiment of the present invention.

A first embodiment of the present invention will be explained. FIG. 1 is a perspective view showing an electrical connector 1 according to the first embodiment of the present invention.

As shown in FIG. 1, the electrical connector 1 includes power source blades 10, signal blades 30, and a holding portion 50. More specifically, in the electrical connector 1 shown in FIG. 1, one of the power source blades 10 formed in a plate shape and four of the signal blades 30 are arranged on one plane to form one group. In the electrical connector 1, two groups of the power source blades 10 and the signal blades 30 are paired to face each other, and are inserted in blade holding holes 51 of the holding portion 50, respectively.

In the embodiment, the electrical connector 1 holding the power source blades 10 and the signal blades 30 is arranged on a circuit board (not shown), and is connected to a corresponding portion of the circuit board with solder. Further, the electrical connector 1 receives a mating connector (not shown) connected to another circuit board, so that the circuit board is electrically connected to another circuit board.

In the embodiment, each of the power source blades 10 includes connecting portions 12A of power circuit portions 12 formed of a metal plate at an upper end portion of a surface thereof facing inside the blade holding hole 51. Further, each of the power source blades 10 includes connecting portions 12B of the power circuit portions 12 protruding in a teeth shape at a lower end portion of the surface thereof.

In the embodiment, each of the signal blades 30 includes connecting portions 32A of a plurality of signal circuit portions 32 at an upper end portion of a surface thereof facing inside the blade holding hole 51. Further, each of the signal blades 30 includes connecting portions 32B of the signal circuit portions 32 protruding from a lower end portion of the surface thereof.

When the electrical connector 1 is connected to the circuit board, the connecting portions 12B of the power source blades 10 and the connecting portions 32B of the signal blades 30 are connected to the circuit board with solder. The holding portion 50 has guide posts 52 at both side end portions thereof for guiding the mating connector, so that a corresponding portion of the mating connector is accommodated in a space between the groups of the power source blade 10 and the signal blades 30.

Figure 2B:
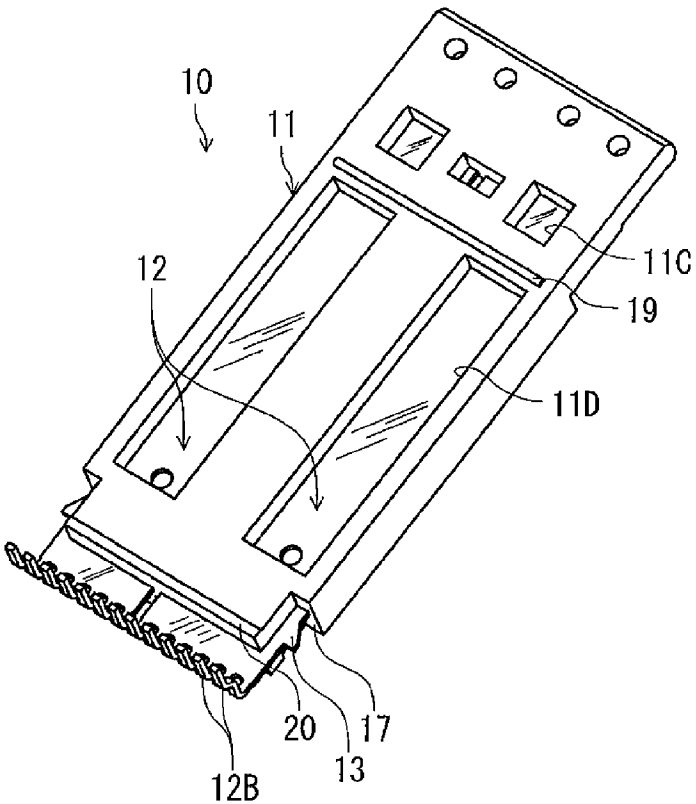
Figure 2A:
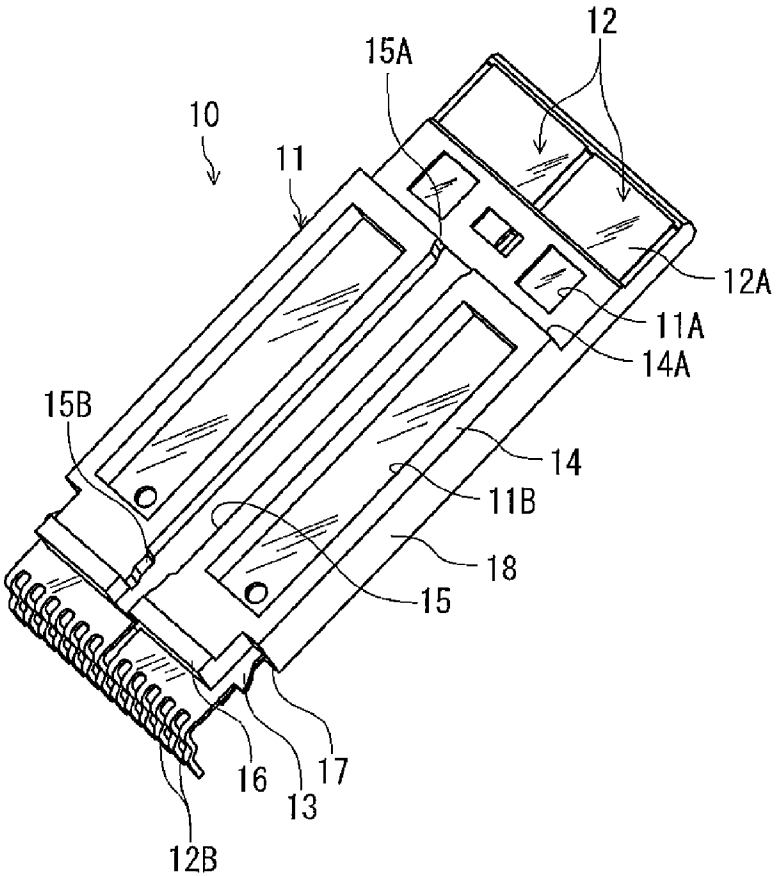

A configuration of each of the power source blade 10, the signal blades 30, and the holding portion 50 will be explained in more detail next. FIGS. 2(A) and 2(B) are perspective views showing the power source blade 10 of the electrical connector 1 according to the first embodiment of the present invention. More specifically, FIG. 2(A) is a perspective view showing an inner surface side of the power source blade 10 of the electrical connector 1, and FIG. 2(B) is a perspective view showing an outer surface side of the power source blade 10 of the electrical connector 1.

As shown in FIGS. 2(A) and 2(B), the power source blade 10 includes the power circuit portions 12 formed of a metal plate, and the power circuit portions 12 are integrated and held with a base member 11 formed of an insulation material through an integration molding. The power circuit portions 12 are arranged and held such that plate surfaces thereof are situated on one plane. Further, portions of the power circuit portions 12 are exposed from the base member 11. The power circuit portions 12 have slightly different widths and similar configurations.

In the embodiment, each of the power circuit portions 12 is formed in a rectangular shape, and has the connecting portion 12A in a flat plate shape at an upper end portion thereof as one end portion and the connecting portions 12B in a teeth shape at a lower end portion thereof. Further, each of the power circuit portions 12 is held with the base member 11 such that a middle portion thereof is partially exposed from the base member 11. The connecting portions 12A at the upper end portion are formed in a flat plate shape, and the connecting portions 12B at the lower end portion are bent perpendicularly relative to the plate surface and formed in a teeth shape at the bent portion thereof.

In the embodiment, each of the power circuit portions 12 further includes an engaging protrusion 13 on a side edge thereof at a position slightly above the connecting portions 12B at the lower end portion. The engaging protrusion 13 is formed in a rectangular wing shape having a slant edge at an upper side thereof and a right angle edge at a lower side thereof.

In the embodiment, the base member 11 is formed in a substantially flat plate shape, and holds the power circuit portions 12 within a thickness thereof. The base member 11 has an inner surface facing inside the blade holding hole 51 of the holding portion 50 (refer to FIG. 2(A)) and an outer surface facing a sidewall of the holding portion 50 (refer to FIG. 2(B)).

As shown in FIG. 2(A), the base member 11 has small window portions 11A and long window portions 11B in the inner surface thereof, so that the power circuit portions 12 are partially exposed. Further, the connecting portions 12A of the power circuit portions 12 having a flat plate shape at the upper end portion are exposed on the inner surface side of the base member 11, and the small window portions 11A are situated at positions adjacent to the connecting portions 12A.

In the embodiment, circuit portion holding portions 14 with a frame shape are disposed at the middle portion of the base member 11 such that the circuit portion holding portions 14 are formed as a step portion having a large thickness around the long window portions 11B. Further, a band groove portion 15 is formed between the circuit portion holding portions 14 corresponding to the power circuit portions 12 to extend in a direction from the upper side to the lower side.

In the embodiment, when the power source blade 10 is inserted into the blade holding hole 51 of the holding portion 50, the band groove portion 15 is guided with a band protrusion portion 54 (described later) formed on the inner surface of the blade holding hole 51. Further, each of the circuit portion holding portions 14 has a regulated portion 14A at an upper end edge surface thereof. When the power source blade 10 is inserted into the blade holding hole 51 of the holding portion 50, the regulated portion 14A abuts against a regulating portion 51A (described later) of the blade holding hole 51 as a corresponding portion, so that the power source blade 10 is positioned at a specific position in an insertion direction.

In the embodiment, tightly holding portions 15A with a large width are formed on opposite guide surfaces of the band groove portion 15 at an upper end portion thereof, and tightly holding portions 15B with a small width are formed on the opposite guide surfaces of the band groove portion 15 at a lower end portion thereof. When the power source blade 10 is completely inserted into the blade holding hole 51 of the holding portion 50, the tightly holding portions 15A and 15B are tightly pressed against tightly holding portions (described later) of the band protrusion portion 54 of the blade holding hole 51 as a corresponding portion, so that the power source blade 10 is fixed and held at the specific position.

In the embodiment, the base member 11 includes a protruding portion 16 at a lower end edge portion thereof. When a user inserts or pulls the power source blade 10 into or out from the holding portion 50, a finger of the user can hook on the protruding portion 16, thereby making it easy to insert or pull out the power source blade 10. Further, the base member 11 includes a cut portion 17 in each of side edges thereof at the lower end portion thereof. With the cut portion 17, the engaging protrusion 13 of the power circuit portions 12 is exposed, so that a distal end portion of the engaging protrusion 13 protrudes slightly beyond a side edge surface 18 of the base member 11.

As shown in FIG. 2(B), the base member 11 includes small window portions 11C and long window portions 11D in the outer surface thereof at positions corresponding to the small window portions 11A and the long window portions 11B. The small window portions 11C and the long window portions 11D have sizes and shapes similar to those of the small window portions 11A and the long window portions 11B. The connecting portions 12A of the power circuit portions 12 at the upper end portion are exposed from the inner surface, and are covered with the base member 11 and not exposed from the outer surface.

In the embodiment, the outer surface of the base member 11 is formed in a substantially flat shape, and has a rib 19 extending in a width direction at a position between the small window portions 11C and the long window portions 11D. The rib 19 is provided for pressing the inner surface of the blade holding hole 51, so that the power source blade 10 does not wobble inside the blade holding hole 51. Further, a protruding portion 20 similar to the protruding portion 16 is formed on the outer surface of the base member 11 for a similar purpose. The cut portion 17 at the lower end portion of the base member 11 extends to the outer surface of the base member 11.

Figure 3B:
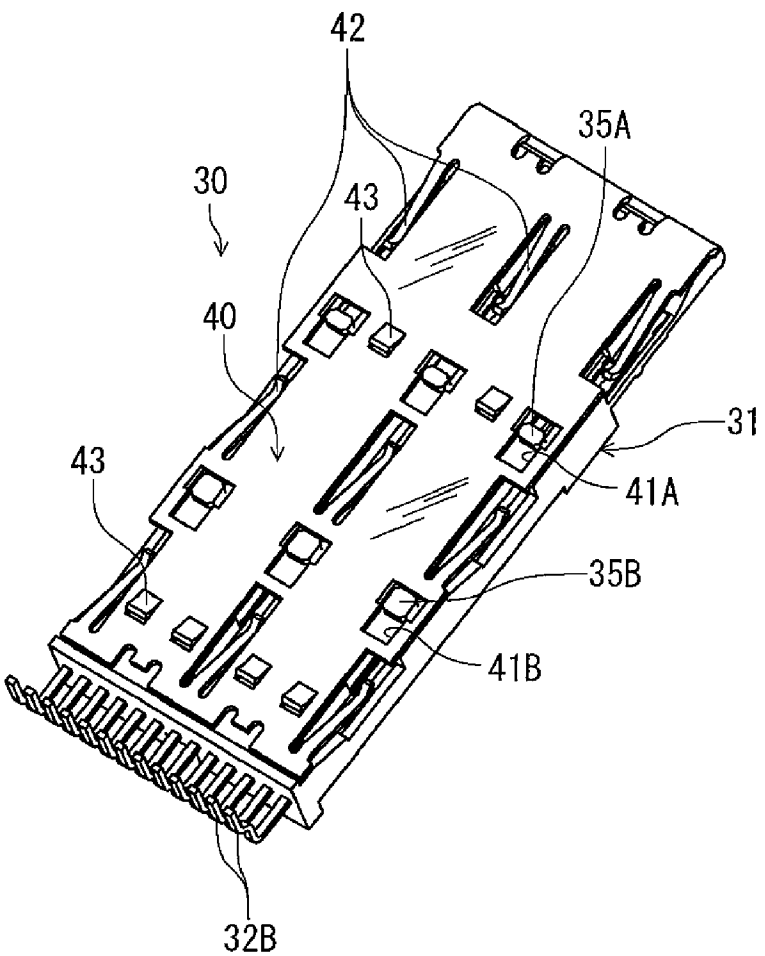
Figure 3A:
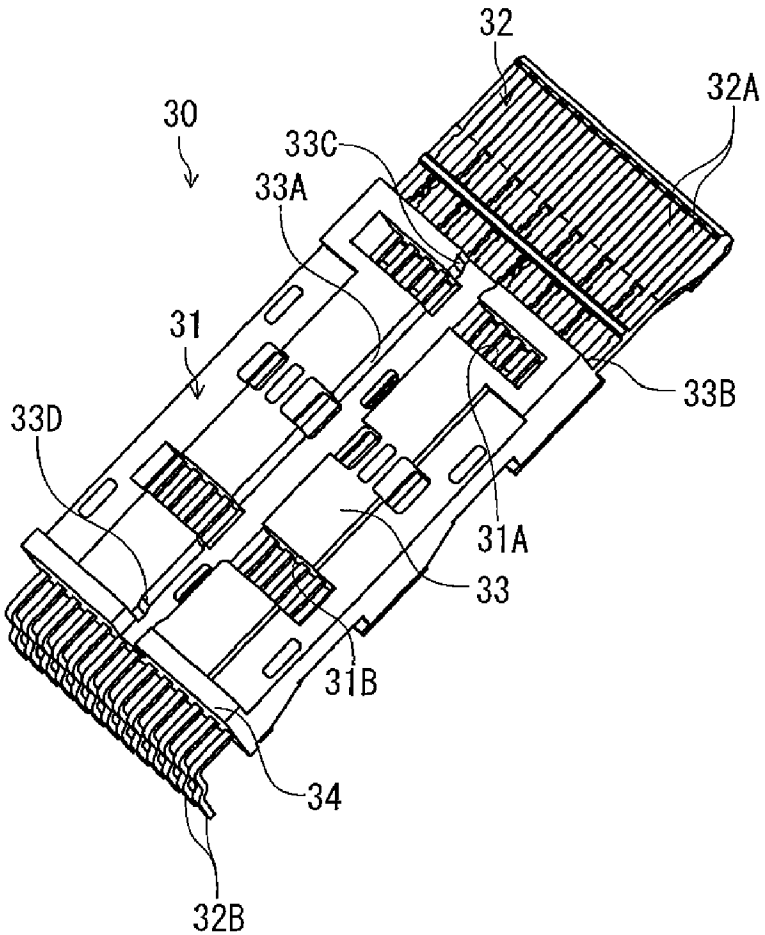

FIGS. 3(A) and 3(B) are perspective views showing the signal blade 30 of the electrical connector 1 according to the first embodiment of the present invention. More specifically, FIG. 3(A) is a perspective view showing an inner surface side of the signal blade 30 of the electrical connector 1, and FIG. 3(B) is a perspective view showing an outer surface side of the signal blade 30 of the electrical connector 1.

As shown in FIG. 3(A), the signal blades 30 includes a plurality of signal circuit portions (terminals) 32 formed in a thin band shape, and the signal circuit portions 32 are held with a base member 31 formed of an insulation material. Similar to the power circuit portions 12, the signal circuit portions 32 are integrated and held with the base member 31 formed of an insulation material through an integration molding. Further, portions of the signal circuit portions 32 are exposed from the base member 31.

In the embodiment, each of the signal circuit portions 32 is formed in a band shape, and has the connecting portion 32A in a band shape at an upper end portion thereof as one end portion and the connecting portion 32B in a bent shape at a lower end portion thereof as the other end portion. The base member 31 has an inner surface facing inside the blade holding hole 51 of the holding portion 50 (refer to FIG. 3(A)) and an outer surface facing the sidewall of the holding portion 50 (refer to FIG. 3(B)).

Similar to the connecting portions 12A of the power circuit portions 12, as shown in FIG. 3(A), the connecting portion 32A of each of the signal circuit portions 32 at the upper end portion is exposed from the inner surface of the base member 31. Further, similar to the connecting portions 12B of the power circuit portions 12, the connecting portion 32B of each of the signal circuit portions 32 at the lower end portion protrudes from a lower edge of the signal circuit portion 32 and bent outward.

In the embodiment, the base member 31 further includes a circuit portion holding portion 33 with a large thickness at a middle portion thereof between the connecting portions 32A and the connecting portions 32B of the signal circuit portions 32, so that the signal circuit portions 32 are embedded in the circuit portion holding portion 33. The circuit portion holding portion 33 has small window portions 31A and 31B. Further, the circuit portion holding portion 33 with a large thickness at the middle portion has a band groove portion 33A extending from the upper side to the lower side thereof.

In the embodiment, when the signal blade 30 is inserted into the blade holding hole 51 of the holding portion 50, the band groove portion 33A is guided with the band protrusion portion 54 (described later) formed on the inner surface of the blade holding hole 51. Further, the circuit portion holding portion 33 has a regulated portion 33A at an upper end edge surface thereof. When the signal blade 30 is inserted into the blade holding hole 51 of the holding portion 50, the regulated portion 33A abuts against the regulating portion 51A (described later) of the blade holding hole 51 as a corresponding portion, so that the signal blades 30 is positioned at a specific position in an insertion direction thereof.

In the embodiment, tightly holding portions 33C with a large width are formed on opposite guide surfaces of the band groove portion 33A at an upper end portion thereof, and tightly holding portions 33D with a small width are formed on the opposite guide surfaces of the band groove portion 33A at a lower end portion thereof. When the signal blade 30 is completely inserted into the blade holding hole 51 of the holding portion 50, the tightly holding portions 33C and 33D are tightly pressed against tightly holding portions (described later) of the band protrusion portion 54 of the blade holding hole 51 as a corresponding portion, so that the signal blades 30 is fixed and held at the specific position.

In the embodiment, similar to the power source blade 10, the base member 31 includes a protruding portion 34 at a lower end edge portion thereof. When the signal blades 30 is inserted into or pulled out from the holding portion 50, a finger can hook on the protruding portion 36, thereby making it easy to insert or pull out the signal blades 30.

In the embodiment, the signal circuit portions 32 are covered with the base member 31 on the outer surface side of the base member 31, and a ground plate 40 is attached to the base member 31 on top of the signal circuit portions 32. The base member 31 includes holding protrusions 35A and 35B for holding the ground plate 40 at corresponding holes 41A and 41B of the ground plate 40. The ground plate 40 further includes contact pieces 42 as a cut portion for contacting with a corresponding ground circuit, so that some of the signal circuit portions 32 are used as a ground circuit. Further, the ground plate 40 includes spring pieces 43 as a cut portion for engaging an engaging portion formed on the inner surface of the blade holding hole 51, so that the signal blade 30 does not wobble inside the blade holding hole 51. It is noted that an upper surface of the ground plate 40 functions as a contact portion for contacting with the mating connector.

Figures 4A, 4B, 4C:
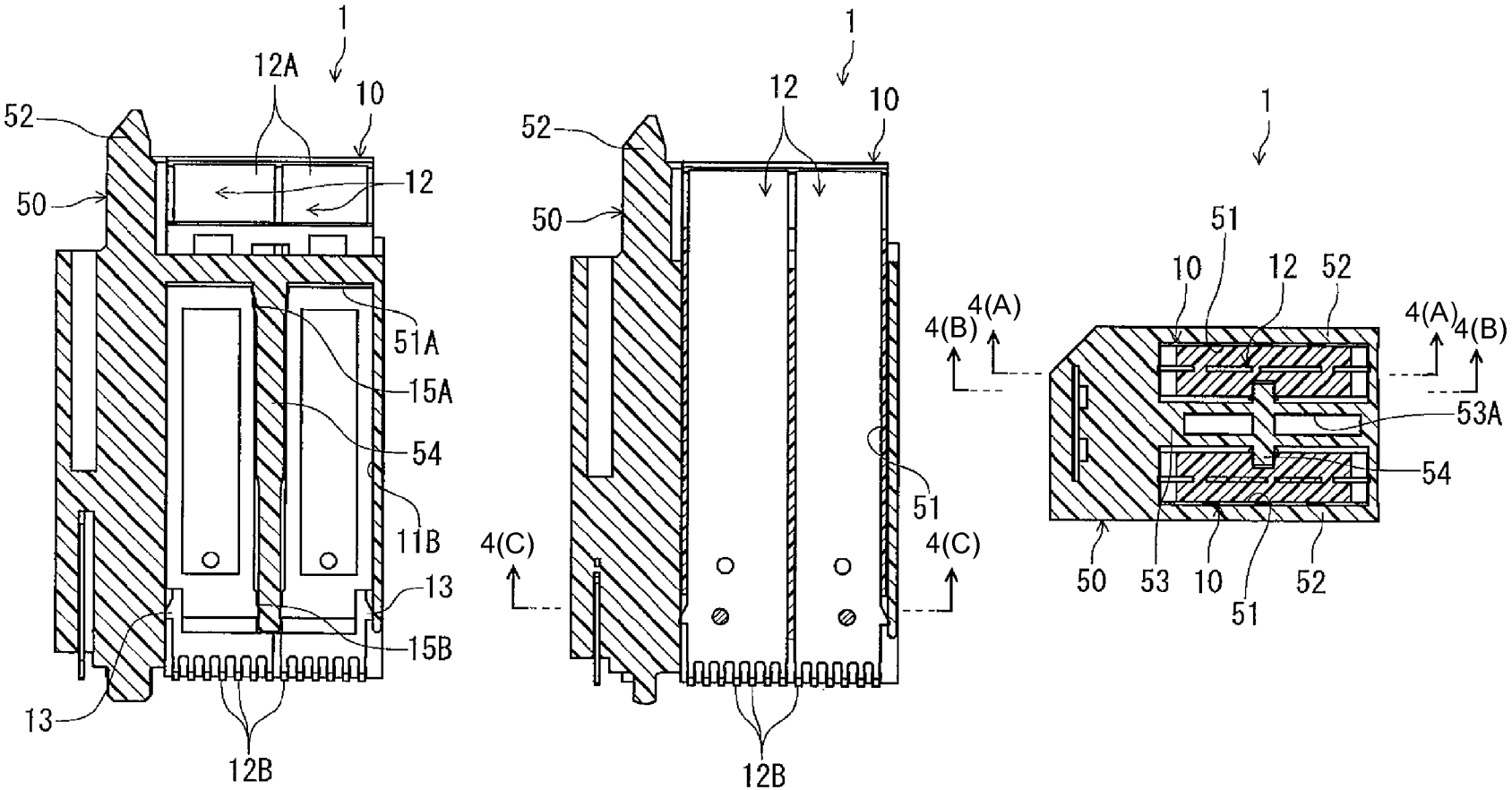

FIGS. 4(A) to 4(C) are sectional views showing the electrical connector 1 according to the first embodiment of the present invention. More specifically, FIG. 4(A) is a sectional view showing the electrical connector 1 taken along a line 4(A)-4(A) in FIG. 4(C), FIG. 4(B) is a sectional view showing the electrical connector 1 taken along a line 4(B)-4(B) in FIG. 4(C), and FIG. 4(C) is a sectional view showing the electrical connector 1 taken along a line 4(C)-4(C) in FIG. 4(B).

As described above, the holding portion 50 holds the two groups of the power source blades 10 and the signal blades 30 with the plate shape in parallel. As shown in FIG. 4(C), the holding portion 50 made of an insulation material is formed in a rectangular tube shape with a small thickness. The holding portion 50 includes the blade holding holes 51 in a slit shape with an intermediate wall 53 in between. Each of the blade holding holes 51 extends along the guide posts 52, and accommodates the power source blade 10 and the signal blades 30.

As shown in FIG. 4(C), the power source blade 10 is retained in the blade holding hole 51 at a left side of the electrical connector 1, and the signal blades 30 (not shown in FIG. 4(C)) are retained in the blade holding hole 51 at a right side. Further, the blade holding hole 51 extends in a direction from the upper side to lower side in FIG. 1. The intermediate wall 53 has slit spaces 53A formed during a molding process of the holding portion 50.

In the embodiment, the band protrusion portion 54 extending in the vertical direction is formed on the intermediate wall 53 in the blade holding hole 51. Accordingly, the band protrusion portion 54 guides the band groove portion 15 of the power source blade 10 shown in FIG. 2(A) and the band groove portion 33A of the signal blade 30 shown in FIG. 3(A) when the power source blade 10 and the signal blade 30 are inserted into the blade holding hole 51.

Further, the band protrusion portion 54 includes a wide width portion at an upper portion thereof and a narrow width portion at a lower end portion thereof as the tightly holding portions. When the power source blade 10 and the signal blade 30 are completely inserted into the blade holding hole 51 of the holding portion 50, the tightly holding portions 15A and 15B of the power source blade 10 at the upper end portion and the lower end portion and the tightly holding portions 33C and 33D of the signal blade 30 at the upper end portion and the lower end portion are tightly pressed against the tightly holding portions of the band protrusion portion 54 of the blade holding hole 51, so that the power source blade 10 and the signal blade 30 are fixed at the specific position.

In the embodiment, when the power source blade 10 is inserted into the blade holding hole 51 of the holding portion 50, first, the connecting portions 12A of the power source blade 10 at the upper end portion are placed at a lower end opening of the blade holding hole 51 of the holding portion 50, so that the power source blade 10 is inserted into the blade holding hole 51 upward. Accordingly, the power source blade 10 is inserted while the band protrusion portion 54 of the blade holding hole 51 and the both side edges of the blade holding hole 51 guide the power source blade 10.

When the power source blade 10 is inserted into the blade holding hole 51 of the holding portion 50 up to the specific insertion position, as shown in FIG. 4(A), the regulated portion 14A of the power source blade 10 abuts against the regulating portion 51A of the blade holding hole 51 as the corresponding portion, so that the power source blade 10 is positioned at the specific insertion position. When the power source blade 10 is positioned at the specific insertion position, the tightly holding portions 15A and 15B of the power source blade 10 are tightly pressed against the wide width portion and the narrow width portion of the band protrusion portion 54 of the blade holding hole 51. Further, as shown in FIG. 4(B), the engaging protrusions 13 formed on the side edges of the power circuit portions 12 of the power source blade 10 engage the inner surface of the blade holding hole 51, so that the power source blade 10 is not come off.

In the embodiment, the signal blade 30 is inserted into the blade holding hole 51 of the holding portion 50 through a process similar to that of the power source blade 10. Accordingly, with the regulated portions 33B, the signal blades 30 is fixed at the specific position inside the blade holding hole 51. Further, with the tightly holding portions 33C and 33D, the signal blades 30 is tightly held inside the blade holding hole 51. Further, with the spring pieces 38 of the ground plate 40, the signal blade 30 does not wobble inside the blade holding hole 51 in the width direction thereof, and is not come off. When the power source blade 10 and the signal blade 30 are completely inserted into the blade holding hole 51 of the holding portion 50, the electrical connector 1 shown in FIG. 1 is completely assembled.

In the embodiment, after the electrical connector 1 is completely assembled, the connecting portions 12B at the lower end portion of the power circuit portions 12, the connecting portions 32B at the lower end portion of the signal circuit portions 32, and attachment metal members 60 are connected to the circuit board (not shown) with solder, thereby attaching the electrical connector 1 to the circuit board. After the electrical connector 1 is attached to the circuit board, the mating connector (not shown) connected to another circuit board is connected to the electrical connector 1 from above.

Accordingly, the mating connector is connected to the electrical connector 1 through the connecting portions 12A at the upper end portion of the power source blade 10, the connecting portions 32A at the upper end portion of the signal blades 30, and the contacting portion at the upper end portion of the ground plate 40 each protruding from the blade holding hole 51.

Second Embodiment

A second embodiment of the present invention will be explained next. In the first embodiment, the holding portion 50 is formed of one single member. In the second embodiment, the holding portion 50 is divided into two divided members. Components in the second embodiment similar to those in the first embodiment are designated with the same reference numerals, and explanations thereof are omitted. In the second embodiment, the holding portion 50 is divided into the two divided holding portions, and each of them has a configuration similar to an upper half of the holding portion 50 in the first embodiment, thereby being designated as the divided holding portions 50.

Figure 5:
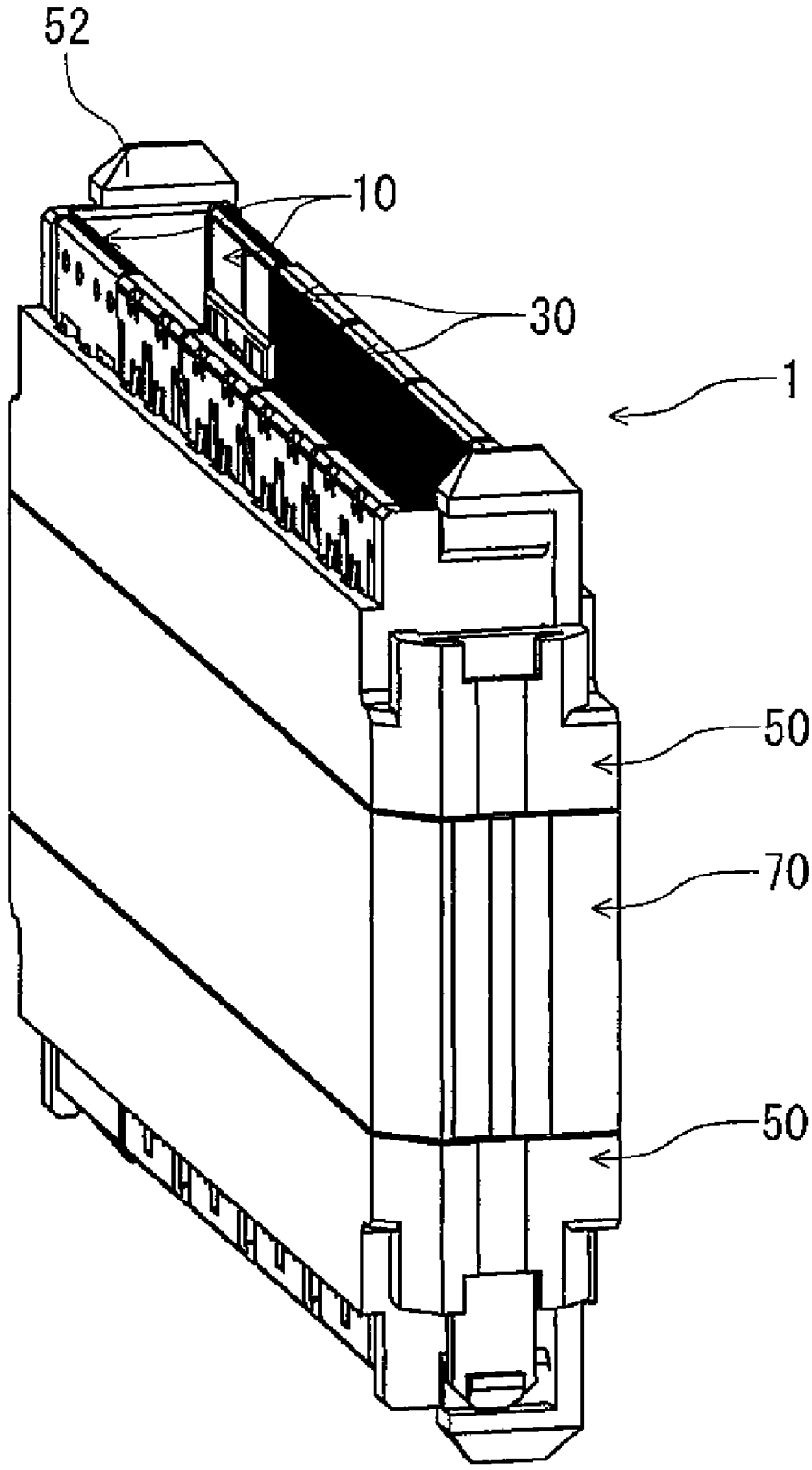
FIG. 5 is a perspective view showing an electrical connector according to a second embodiment of the present invention.

FIG. 5 is a perspective view showing the electrical connector 1 according to the second embodiment of the present invention. As shown in FIG. 5, similar to the first embodiment, the electrical connector 1 includes the power source blades 10, the signal blades 30, and the divided holding portions 50. More specifically, in the electrical connector 1 shown in FIG. 5, one of the power source blades 10 formed in a plate shape and four of the signal blades 30 are arranged to form one group. In the electrical connector 1, two groups are paired to face each other, and are held with the divided holding portions 50. Further, a spacer member 70 is disposed between the divided holding portions 50, so that the divided holding portions 50 securely hold the power source blades 10 and the signal blades 30.

Figure 6B:
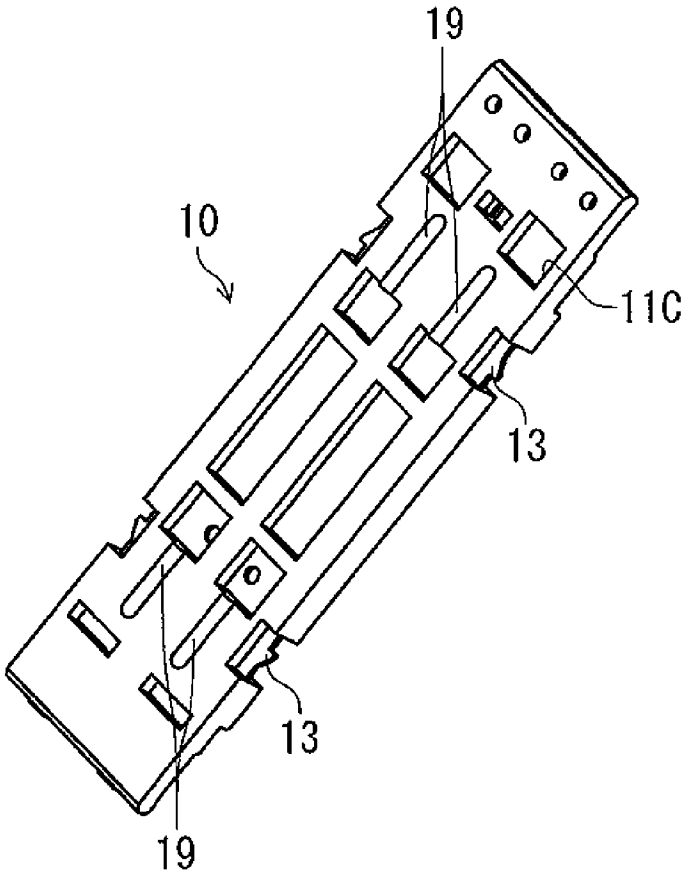
Figure 6A:
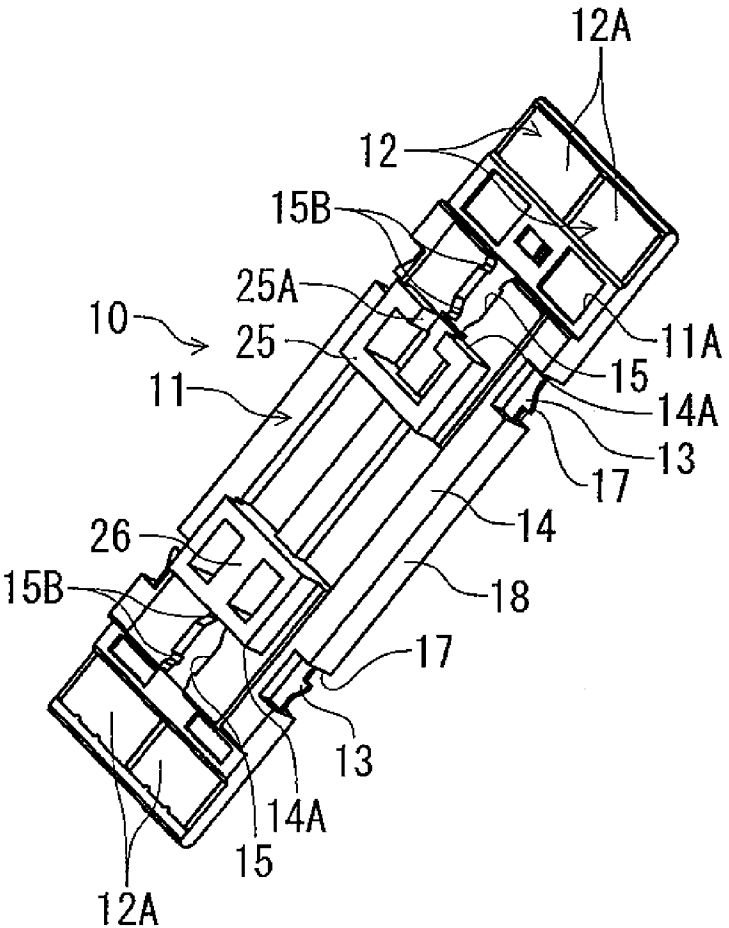

FIGS. 6(A) and 6(B) are perspective views showing the power source blade 10 of the electrical connector 1 according to the second embodiment of the present invention. More specifically, FIG. 6(A) is a perspective view showing an inner surface side of the power source blade 10 of the electrical connector 1, and FIG. 6(B) is a perspective view showing an outer surface side of the power source blade 10 of the electrical connector 1.

As shown in FIG. 6(A), the power source blade 10 has substantially symmetrical upper and lower end portions. Further, the power circuit portions 12 have the connecting portions 12A in a flat plate shape at the both end portions thereof, and do not have the connecting portions 12B in the teeth shape as those in the first embodiment. The circuit portion holding portions 14 are disposed at the middle portion of the base member 11 between the connecting portions 12A at the upper and lower end portions in the vertical direction. The circuit portion holding portions 14 have regulating protrusions 25 and 26 at the upper and lower end portions thereof.

In the embodiment, the regulating protrusion 25 at the upper end portion has an opening portion 25A and a substantially C character shape. The regulating protrusion 26 at the lower end portion does not have an opening portion and has a closed shape. Further, the regulating protrusion 25 at the upper end portion has the regulated portion 14A at an upper edge thereof, and the regulating protrusion 26 at the lower end portion has the regulated portion 14A at a lower edge thereof.

In the embodiment, the tightly holding portions 15B are disposed as the narrow width portions of the band groove portion 15 between the regulated portions 14A of the regulating protrusions 25 and the upper edges of the circuit portion holding portions 14. Further, the tightly holding portions 15B are disposed as the narrow width portions of the band groove portion 15 between the regulated portions 14A of the regulating protrusions 26 and the lower edges of the circuit portion holding portions 14.

In the embodiment, the base member 11 includes the cut portions 17 in the side edges thereof on sides of the regulated portions 14A at the upper and lower end portions thereof. Accordingly, the engaging protrusions 13 of the power circuit portions 12 protrude at the cut portions 17. The engaging protrusion 13 at the lower end portion is formed in a rectangular wing shape having a slant edge at an upper side thereof. The engaging protrusion 13 at the upper end portion is formed in a rectangular wing shape having a slant edge at a lower side thereof. The distal end portions of the engaging protrusion 13 protrude sideway beyond the side edge surfaces 18 of the base member 11.

As shown in FIG. 6(B), in the power source blade 10, the base member 11 covers the connecting portions 12A of the power circuit portions 12 at the both end portions thereof on the outer surface side of the power source blade 10. The base member 11 includes the ribs 19 protruding and extending in the vertical direction at positions substantially corresponding to the engaging protrusions 13 in the vertical direction.

Figure 7B:
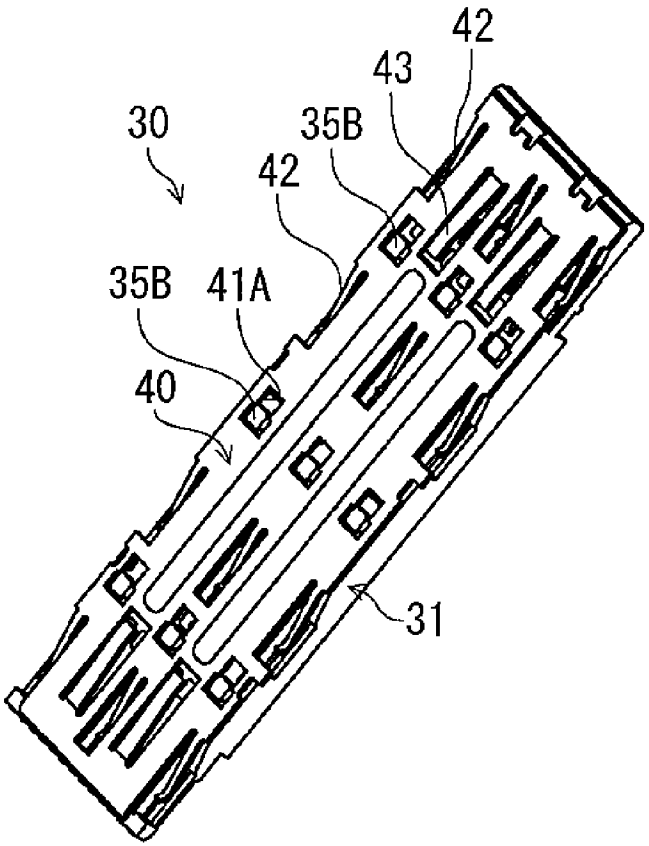
Figure 7A:
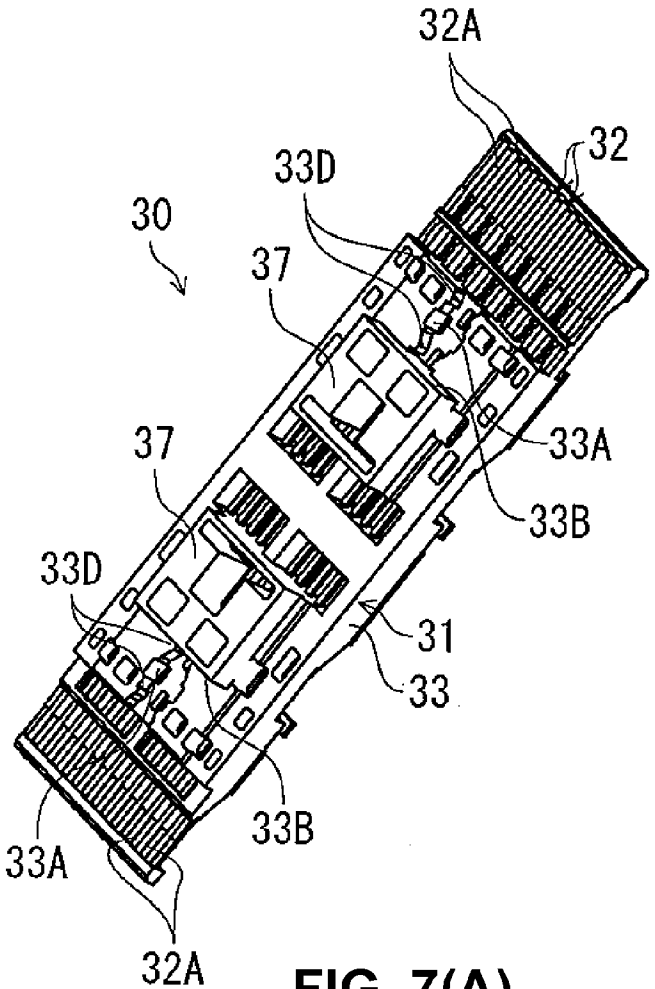

FIGS. 7(A) and 7(B) are perspective views showing the signal blade 30 of the electrical connector 1 according to the second embodiment of the present invention. More specifically, FIG. 7(A) is a perspective view showing an inner surface side of the signal blade 30 of the electrical connector 1, and FIG. 7(B) is a perspective view showing an outer surface side of the signal blade 30 of the electrical connector 1.

As shown in FIGS. 7(A) and 7(B), the signal blade 30 has substantially symmetrical upper and lower end portions. As shown in FIG. 7(A), the signal blade 30 includes a plurality of signal circuit portions 32 in a band shape. The connecting portions 32A of the signal circuit portions 32 have a narrow band shape at the upper and lower end portions of the signal circuit portions 32, and do not have the teeth shape as those in the first embodiment.

In the embodiment, the base member 31 includes the circuit portion holding portion 33 at the middle portion thereof between the connecting portions 32A, and the circuit portion holding portion 33 includes regulating protrusions 37 at the upper end portion and the lower end portion thereof. The regulating protrusion 37 at the upper end portion includes the regulated portion 33B at an upper edge portion thereof. The regulating protrusion 37 at the lower end portion also includes the regulated portion 33B at a lower edge portion thereof.

In the embodiment, the tightly holding portions 33D are disposed as the narrow width portions of the band protrusion portion 33A between the regulated portions 33B and the upper edge of the circuit portion holding portion 33. Further, the tightly holding portions 33D are disposed as the narrow width portions of the band protrusion portion 33A between the regulated portions 33B and the lower edge of the circuit portion holding portion 33.

As shown in FIG. 7(B), similar to the first embodiment, the ground plate 40 is attached to the signal blades 30.

Figure 8B:
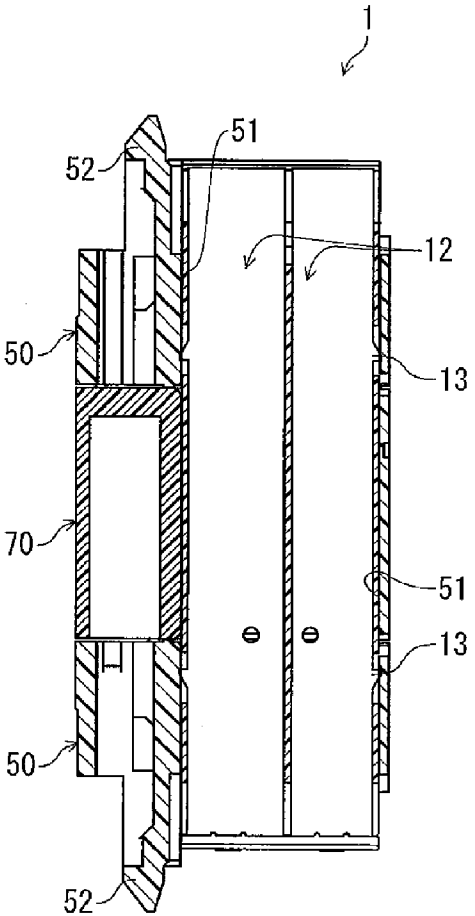
Figure 8A:
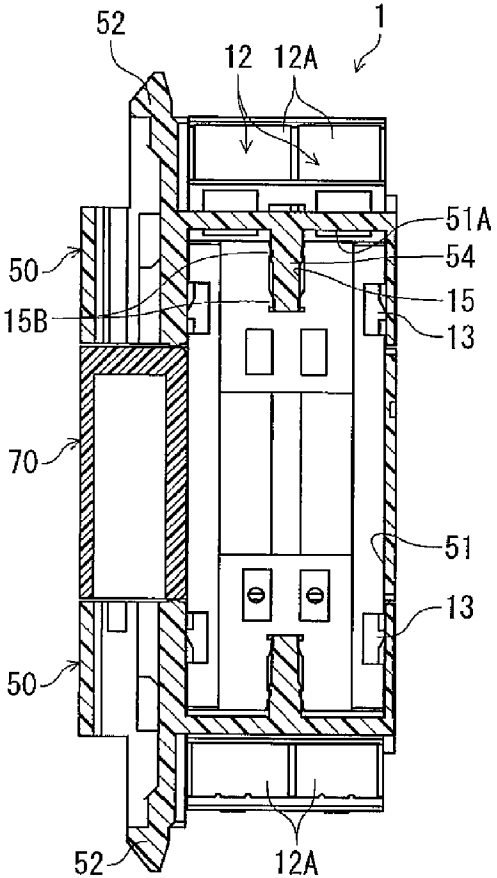

FIGS. 8(A) and 8(B) are sectional views showing the electrical connector 1 according to the second embodiment of the present invention. More specifically, FIG. 8(A) is a sectional view showing the electrical connector 1 corresponding to FIG. 4(A), and FIG. 8(B) is a sectional view showing the electrical connector 1 corresponding to FIG. 4(B).

As shown in FIGS. 8(A) and 8(B), the divided holding portions 50 have an identical configuration, and attached to the two groups of the power source blades 10 and the signal blades 30 from above and below. Further, the spacer member 70 is disposed between the divided holding portions 50. The spacer member 70 is formed of an insulation material, similar to the divided holding portions 50. An outer circumferential surface of the spacer member 70 is flash with those of the divided holding portions 50. An inner circumferential surface of the spacer member 70 is formed as a rectangular tube inner surface with a slit shape, so that the power source blades 10 and the signal blades 30 pass therethrough without engaging the inner circumferential surface. It is configured such that the spacer member 70 abuts against the divided holding portions 50 in the vertical direction, thereby securely positioning the divided holding portions 50.

In the embodiment, each of the divided holding portions 50 includes the guide posts 52 at the end portions thereof in the vertical direction, and the blade holding hole 51 passing therethrough in the vertical direction. The regulating portions 51A are formed on the inner surface of the blade holding hole 51 for abutting against the regulated portions 14A of the power source blade 10. Further, the band protrusion portions 54 extend from the regulating portions 51A downward for guiding the power source blade 10 through the band groove portion 15 of the power source blade 10.

In the embodiment, when the electrical connector 1 is assembled, first, one of the divided holding portions 50 is attached to the power source blades 10 and the signal blades 30 from above, and the spacer member 70 is attached to the power source blades 10 and the signal blades 30 from below. Afterward, the other of the divided holding portions 50 is attached to the spacer member 70 from below. When the divided holding portions 50 are attached, similar to the first embodiment, the band protrusion portions 54 of the divided holding portions 50 guide the band groove portions 15, and the regulated portions 14A abut against the regulating portions 51A, thereby positioning the power source blades 10.

Further, the engaging protrusions 13 engage the inner surfaces of the blade holding holes 51 of the divided holding portions 50, thereby preventing the power source blades 10 from coming off. Further, the tightly holding portions 15B are tightly held at the band protrusion portions 54 of the divided holding portions 50. Further, the divided holding portions 50 are attached to the signal blades 30 in a way similar to the power source blade 10.

In the embodiment, after the electrical connector 1 is assembled, the mating connectors connected to the circuit boards are attached to the electrical connector 1 from above and below, respectively.

Third Embodiment

A third embodiment of the present invention will be explained next. In the third embodiment, the power source blade 10 and the signal blades 30 are collectively attached to the holding portion 50 using a jig 80. In the following description, the power source blade 10 in the second embodiment and the signal blades 30 in the first embodiment are explained as an example.

Figure 9B:
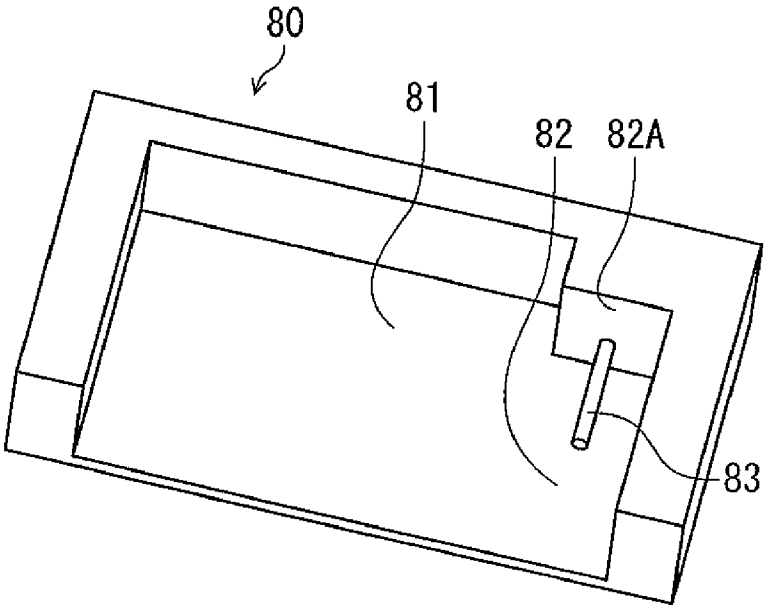
Figure 9A:
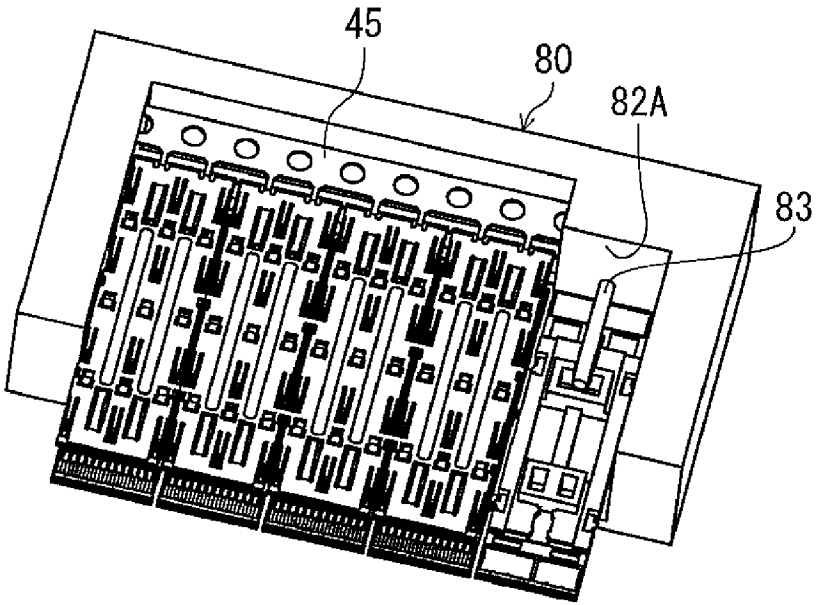

FIGS. 9(A) and 9(B) are perspective views showing the power source blade 10 and the signal blades 30 of the electrical connector 1 according to the third embodiment of the present invention. More specifically, FIG. 9(A) is a perspective view showing the power source blade 10 and the signal blades 30 of the electrical connector 1 in a state that the electrical connector is set in the jig 80, and FIG. 9(B) is a perspective view showing the jig 80.

As shown in FIG. 9(A), the ground plates 40 of the signal blades 30 are connected to each other through a carrier 45. After the signal blades 30 are inserted into the holding portion 50, the carrier 45 is cut from the ground plate 40. As described above, the power source blade 10 does not have the ground plate 40. Accordingly, the power source blade 10 may be inserted into the holding portion 50 in a wrong direction. In order to avoid the problem, the jig 80 is used to collectively insert the power source blade 10 and the signal blades 30 into the holding portion 50.

As shown in FIG. 9(B), the jig 80 includes a signal blade receiving portion 81 for receiving the signal blades 30 with the carrier 45 from a side of the carrier 45, and a power source blade receiving portion 82 for receiving the power source blade 10 at a specific position relative to the signal blades 30. The signal blade receiving portion 81 has a depth greater by a distance corresponding to the carrier 45 and a protruding length of the upper end portions of the signal blades 30 relative to the power source blade 10.

In the embodiment, a regulating bar 83 protrudes from a rear inner wall 82A in the power blade receiving portion 82. The regulating bar 83 has a sufficient length, so that the regulating bar 83 is inserted into the opening portion 25A formed at the upper end portion of the regulating protrusion 25 of the power source blade 10 shown in FIG. 6(A). Accordingly, even when the power source blade 10 has a dimensional variance, the regulating bar 83 engages the opening portion 15 only at the upper end portion of the power source blade 10. If the power source blade 10 is placed in an opposite way, the regulating bar 83 is not inserted into the regulating protrusion 26 at the lower end portion of the power source blade 10, thereby preventing the power source blade 10 from being inserted in the wrong direction.

In the embodiment, after the power source blade 10 and the signal blades 30 are placed in the jig 80 at a standard position, the power source blade 10 and the signal blades 30 are attached to the holding portion 50 from a lower side in FIG. 9(B). After the power source blade 10 and the signal blades 30 are inserted into the holding portion 50, the jig 80 is detached from the power source blade 10 and the signal blades 30, and the carrier 45 is removed.

In the embodiments described above, the two groups of the power source blades 10 and the signal blades 30 are arranged to face each other. Alternatively, one of the power source blades 10 and the signal blades 30 may be arranged to face each other. Further, the signal blades 30 may not be formed of a print circuit board.

The disclosure of Japanese Patent Application No. 2009-225990, filed on Sep. 30, 2009 is incorporated in the application by reference.

While the invention has been explained with reference to the specific embodiments of the invention, the explanation is illustrative and the invention is limited only by the appended claims.

What is claimed is:

1. An electrical connector, comprising:

a signal blade including a first base member formed of an insulation material and a signal circuit portion mounted on the first base member;

a power source blade including a second base member formed of an insulation material and a power source circuit portion mounted on the second base member, said power source blade further including an engaging protrusion; and a holding member formed of an insulation material and including a blade holding hole so that the engaging protrusion engages an inner surface of the blade holding hole when the power source blade is inserted into the blade holding hole, wherein said power source blade further includes a band groove portion and said holding portion further includes a band protrusion portion so that the band groove portion tightly holds the band protrusion portion when the power source blade is inserted into the blade holding hole.

2. The electrical connector according to claim 1, wherein said signal blade further includes a first guided side edge and said power source blade further includes a second guided side edge.

3. The electrical connector according to claim 1, wherein said power source blade further includes a regulated portion and said holding portion further includes a regulating portion for abutting against the regulated portion so that the power source blade is positioned at a specific position when the power source blade is inserted into the blade holding hole.

4. The electrical connector according to claim 1, wherein said holding portion is formed in a single body member so that the power source blade is inserted into the blade holding hole in one direction, said engaging protrusion being situated an end portion of the inner surface in the one direction.

5. The electrical connector according to claim 1, wherein said power source blade further includes a rib for pressing the inner surface.

* * * * *